US006422904B1

(12) United States Patent
Davies et al.

(10) Patent No.: US 6,422,904 B1
(45) Date of Patent: Jul. 23, 2002

(54) WATER JET PROPULSION UNIT FOR USE IN WATER BORNE CRAFT

(76) Inventors: Richard Gwyn Davies, 15 Dondonald Street, Dunedin; Barry John Davies, 39 Orawia Road, Tuatapere, Southland, both of (NZ)

( * ) Notice: Subject to any disclaimer, the term of this patent is extended or adjusted under 35 U.S.C. 154(b) by 0 days.

(21) Appl. No.: 09/622,048

(22) PCT Filed: Dec. 24, 1999

(86) PCT No.: PCT/NZ99/00229

§ 371 (c)(1),
(2), (4) Date: Oct. 16, 2000

(87) PCT Pub. No.: WO00/38980

PCT Pub. Date: Jul. 6, 2000

(30) Foreign Application Priority Data

Dec. 24, 1998 (NZ) ..... 330326

(51) Int. Cl.[7] ..... B63H 11/00

(52) U.S. Cl. ..... 440/38

(58) Field of Search ..... 114/150, 151; 440/49, 50, 38, 47, 80, 81

(56) References Cited

U.S. PATENT DOCUMENTS 3,970,027 A * 7/1976 Jackson ..... 114/151
4,828,518 A * 5/1989 Kouda et al. ..... 440/50
5,634,831 A * 6/1997 Davies et al. ..... 440/47

* cited by examiner

*Primary Examiner*—Stephen Avila

(57) ABSTRACT

A water jet propulsion unit for water borne craft including two contra rotating impellers, located in an upstream pump housing and a downstream pump housing respectively, and mounted on coaxial shafts. A pressure control priming device in the form of a spring loaded collapsible skirt is located between the impellers. The pressure in the downstream pump housing can be maintained at atmospheric pressure by the controlled admission of air through air inlets.

7 Claims, 6 Drawing Sheets

WATER JET PROPULSION UNIT FOR USE IN WATER BORNE CRAFT

TECHNICAL FIELD

The present invention relates to water jet propulsion units for use in water borne craft

BACKGROUND OF THE INVENTION

This specification describes three water jet propulsion unit designs which contain a pair of counter-rotating impellers in in-line arrangement being driven forwardly on two coaxially arranged shafts. The means for driving the impellers are typically described in our NZ Patent No. 256488.

The designs depart from previous design and operating criteria, in that we require that the downstream impeller, in each case, operate at atmospheric pressure. Unlike the designs described in our NZ patent No 256488, where a hydraulic balance is maintained so that nozzle/internal pump pressures are in the range of about 0 to 276 kPa, in these designs only the upstream impeller/nozzle section operates within this pressure regime. Notwithstanding this, the upstream impeller/nozzle section may be also configured to operate at pressures above 276 kPA.

In energy terms this means that the downstream impeller blades, in these new designs, impart kinetic energy directly to the jet stream. Further advantages include the removal of back pressure effects on the downstream impeller and losses arising from pressure energy conversion at the nozzle outlet. In these designs the nozzle is now placed between the impellers and the opening, downstream of the downstream impeller, is now merely an outlet for the pump (As opposed to being a nozzle). The introduction of air to the downstream impeller. FIGS. 2, 3, 4, 5 and 6 further reduces frictional losses in the impeller casing but more importantly allows the downstream impeller to operate at atmospheric pressure.

MODE OF OPERATION

To facilitate priming of the upstream impeller 5 an external pressure control priming device 10, comprising a collapsible skirt and peripheral spring, as seen in FIGS. 1, 2, 5 and 6 is placed between the two impellers 5 and 6. In FIG. 3 the pressure control priming device 19 is fixed to the centre of the upstream impeller 5 and consists of a collapsible skirt 20 within which is placed a plunger cone 21 and tensioning spring (not shown) whereby the pressure of the water forces the skirt 20 and plunger cone 21 in and out. The air inlet(s) 12 in the pump casing, FIGS. 2, 3, 4, 5 and 6 are provided with close-off flaps 13, FIG. 2 which are pressure controlled. Once a primed condition is achieved they remain open to permit continuous air entry. The provision of air inlets 12 thus allows the downstream impeller 6 to assist in priming the pump when they are closed. In FIG. 1 no air entry is permitted between the two impellers, but delivery rates between the two impellers must be carefully adjusted to ensure that the two impellers are hydraulically balanced in respect of flow rate, so that the downstream impeller always operates at atmospheric pressure.

A further improvement allows for the blades of the downstream impeller 6 to be automatically adjusted whereby the peripheral blade angles of the impeller 6 may be varied or calibrated according to the helical flow impinging on it from the upstream impeller 5. This feature is made possible because the blade to pump housing clearances are much greater than that required of a pressure pump so that the blades of the impeller 6 may be rotated slightly within the circular casing of the pump housing 8.

In very simple terms, the devices described are thus a pressurised pump section, containing the upstream impeller, followed by a propeller operating at atmospheric pressure, enclosed in a casing.

In a further design departure, not shown, the downstream section of the unit may simply consist of a ringed impeller whereby a ring is fixed directly to the outer edge of the impeller blades. No pump casing thus being required.

Also not described is a pump of essentially the same design configuration and having the same operating criteria, as described in any of the drawings, whereby the upstream impeller is of "mixed flow design", followed by a downstream impeller of "axial flow" design. In this case the pressure control priming device is also between the impellers, together with the features already outlined for the totally axial flow design (FIGS. 1 to 6).

The designs are based on the principle of a high mass, low pressure and throttled configuration as described in our NZ patent 256488, such that improved efficiency is achieved by maximising the flow rate through the jet propulsion unit at the lowest possible internal unit pressure. Typically, impeller peripheral blade angles fall in the range of about 30 to 50 degrees, depending on power input but may fall outside this range should impeller diameters be altered or the pumps operating requirements change. Impeller peripheral tip speeds, relative to in-pump flow velocities, are usually limited to the range of about 45 to 65 meters/second, to restrict the damaging effects of cavitation. For specific applications, for example boat racing, where high boat speed is required, such a peripheral tip speed restriction may, however, be ignored by the user. The provision of air to the downstream impeller also helps to reduce the effects of cavitation. In respect of impeller design, the downstream impeller is no longer required to have a "pressure" configuration where the blades are normally aligned or over-lapped. Instead the blades may have a more open architecture as applies in conventional propeller design or a "cleaver" shape typical of those found in surface piercing drives. In our case however it is desirable to maintain the outer edge of the blade so that a large portion is contiguous with the wall of the pump housing in order to better control the amount of work carried out by the blade.

DESCRIPTION OF PREFERRED EMBODIMENT

Figure 4:
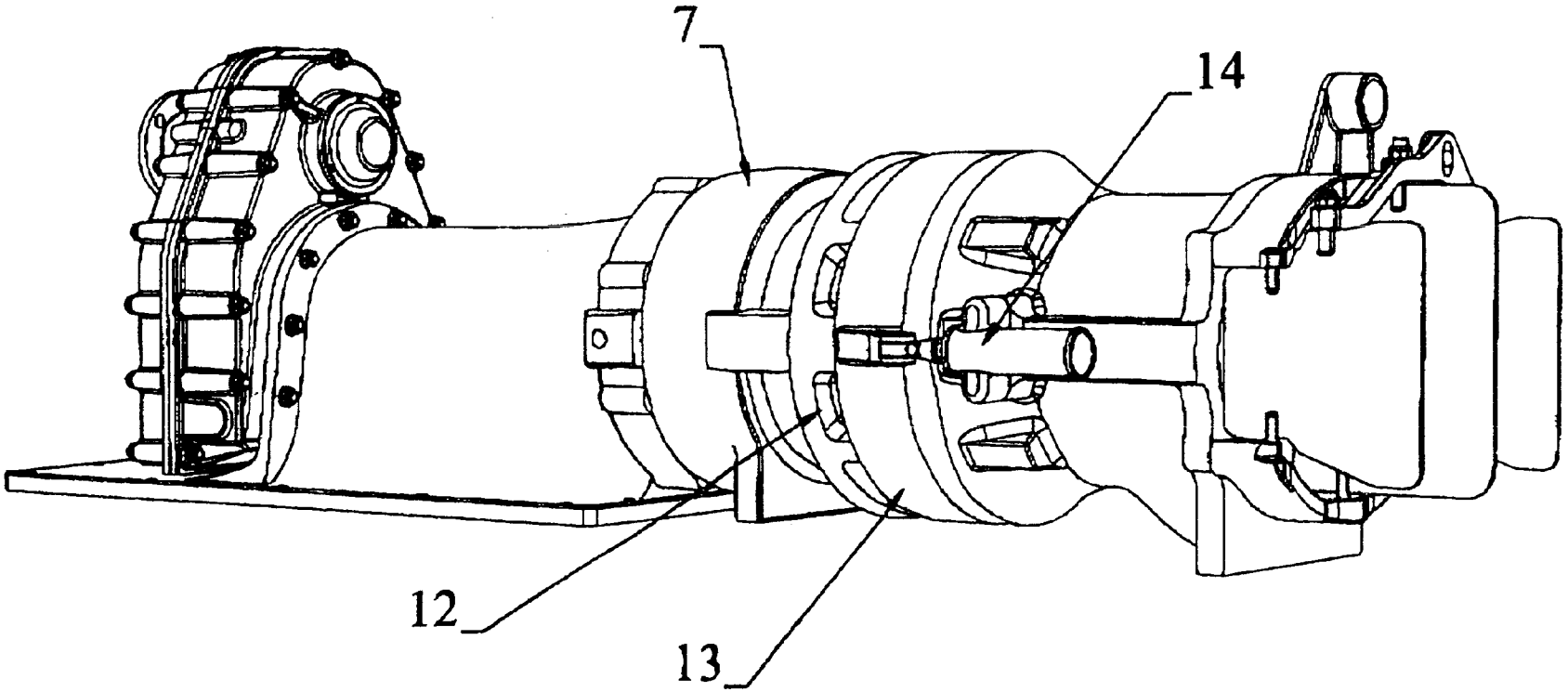
FIG. 4 is an external detailed three dimensional view of the pump unit showing the air entry control system, shown also as FIG. 2.
Figure 5:
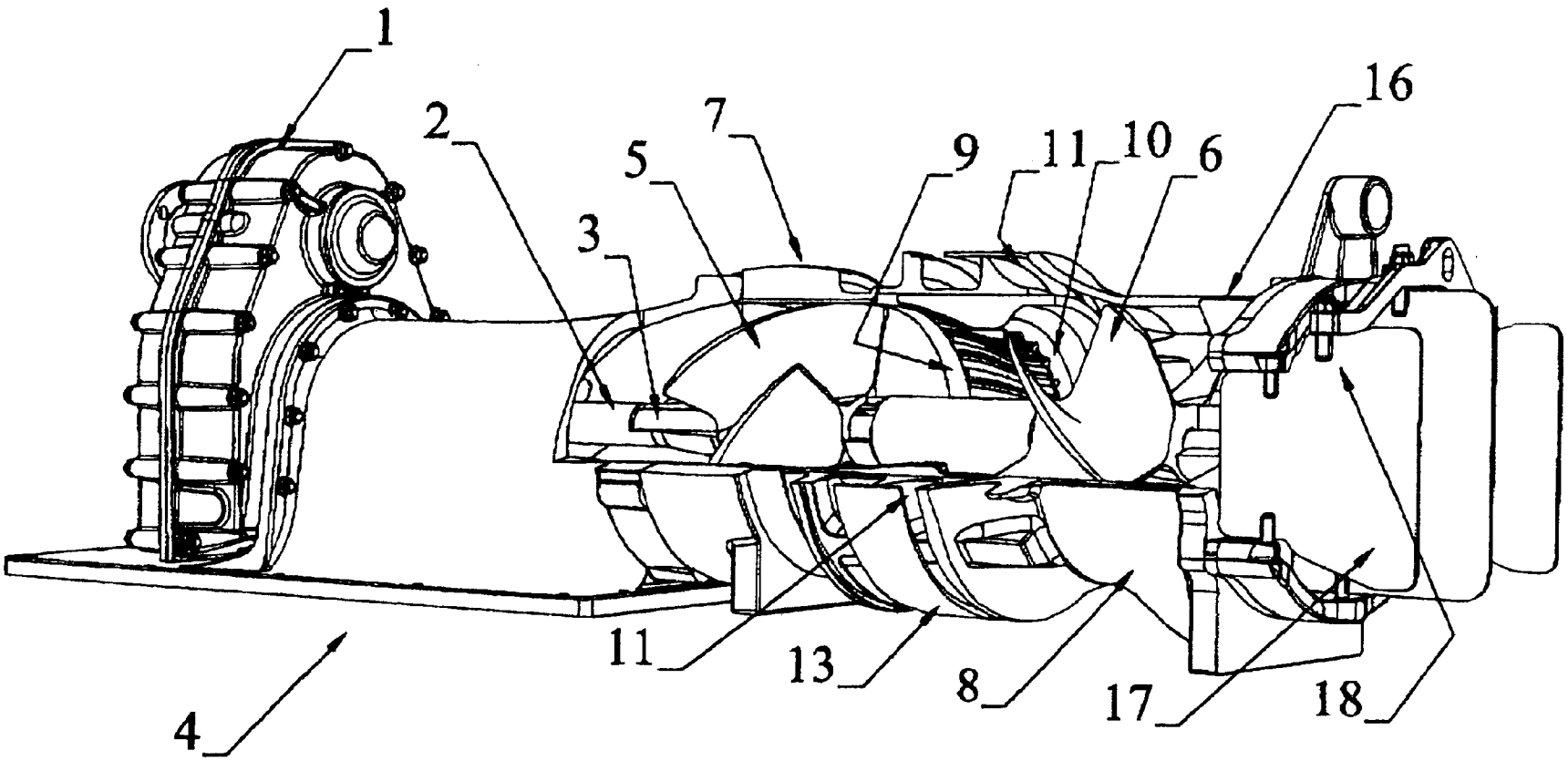
FIG. 5 is cutaway view of FIG. 4 showing the air entry control system, impellers and pressure control priming device (a spring loaded skirt) inside the pump casing.
Figure 6:
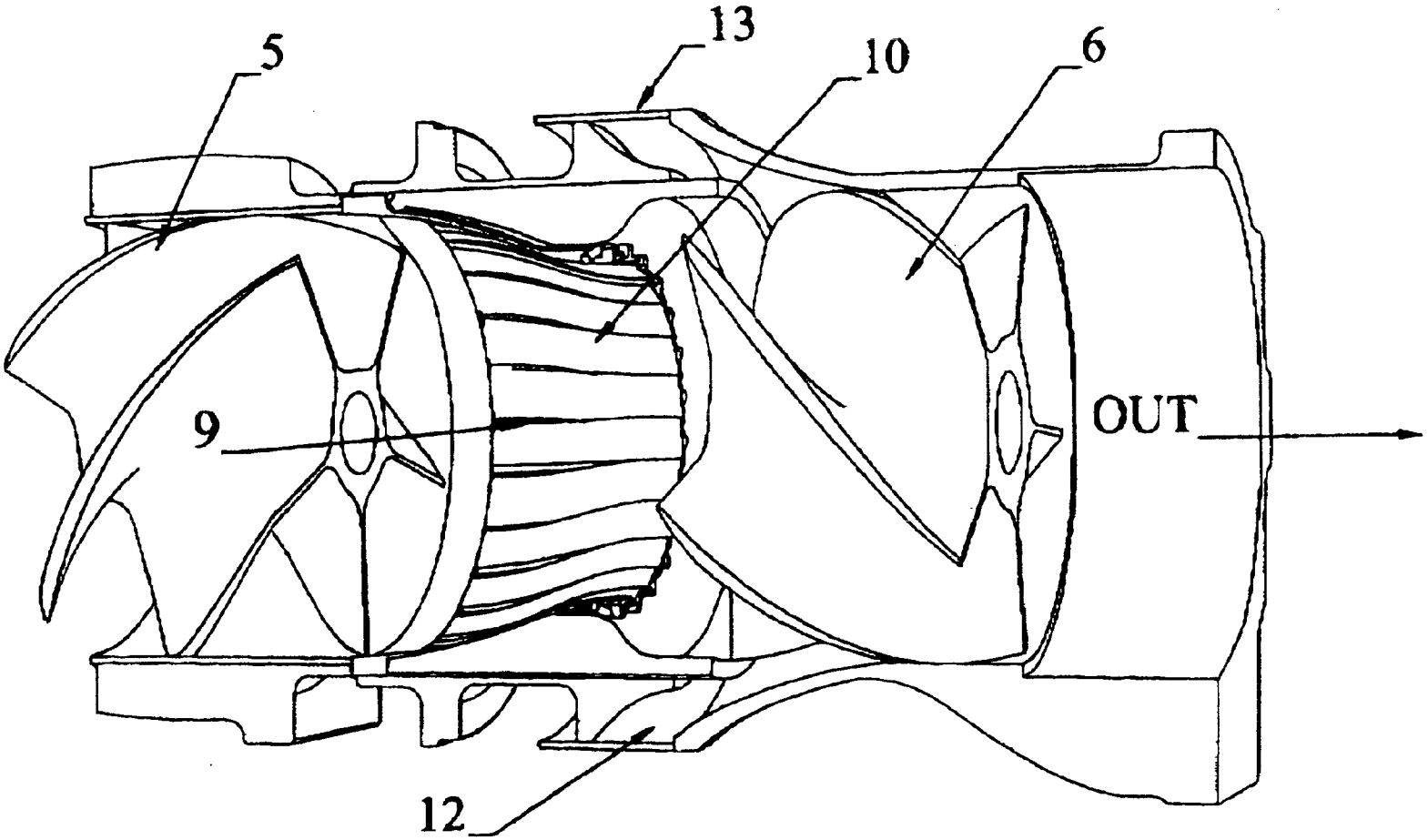
FIG. 6 is a part cutaway view of FIG. 4 showing the air entry control system, the pressure control priming device (a spring loaded skirt) and the two impellers.

FIGS. 4, 5 and 6 describe an axial flow water jet propulsion unit where an engine may be directly coupled to the transmission 1.

Figure 1:
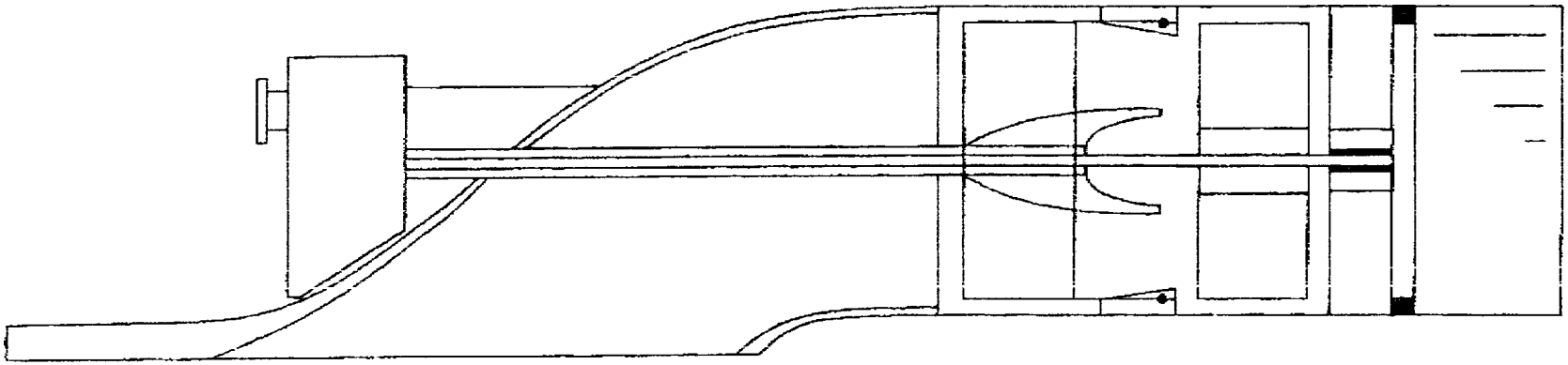
FIG. 1 describes a basic pump unit in a simplified side elevational view with no specific facility for air to be introduced between the impellers. Air may, however, pass down the centre of the jet plume thus allowing some control over pressure between the impellers. A pressure control priming device is located between the impellers at the periphery of the pump casing.
Figure 2:
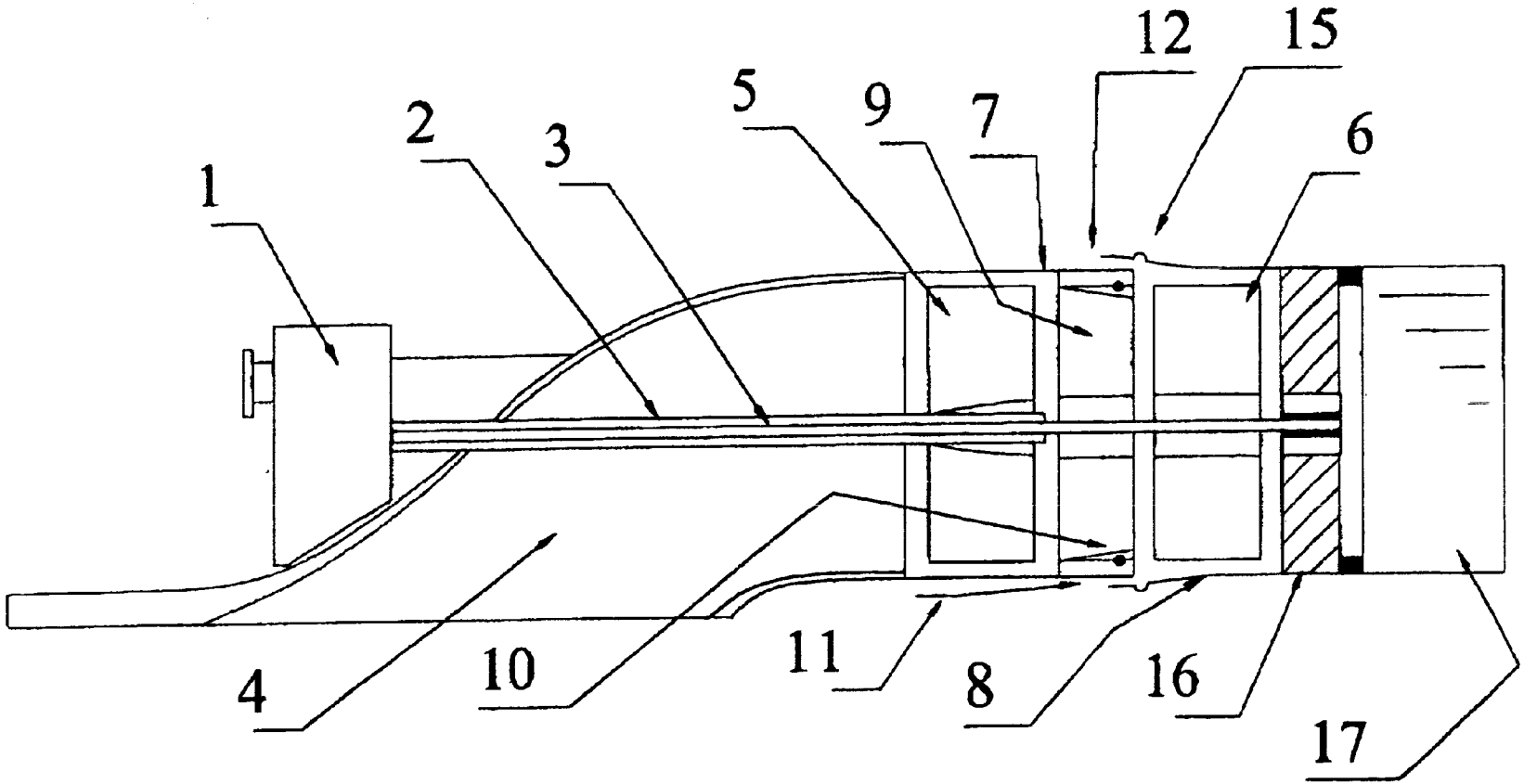
FIG. 2 describes a basic pump unit in a simplified side elevational view with an air entry control system located between the impellers. A pressure control priming device is located between the impellers at the periphery of the pump casing.
Figure 3:
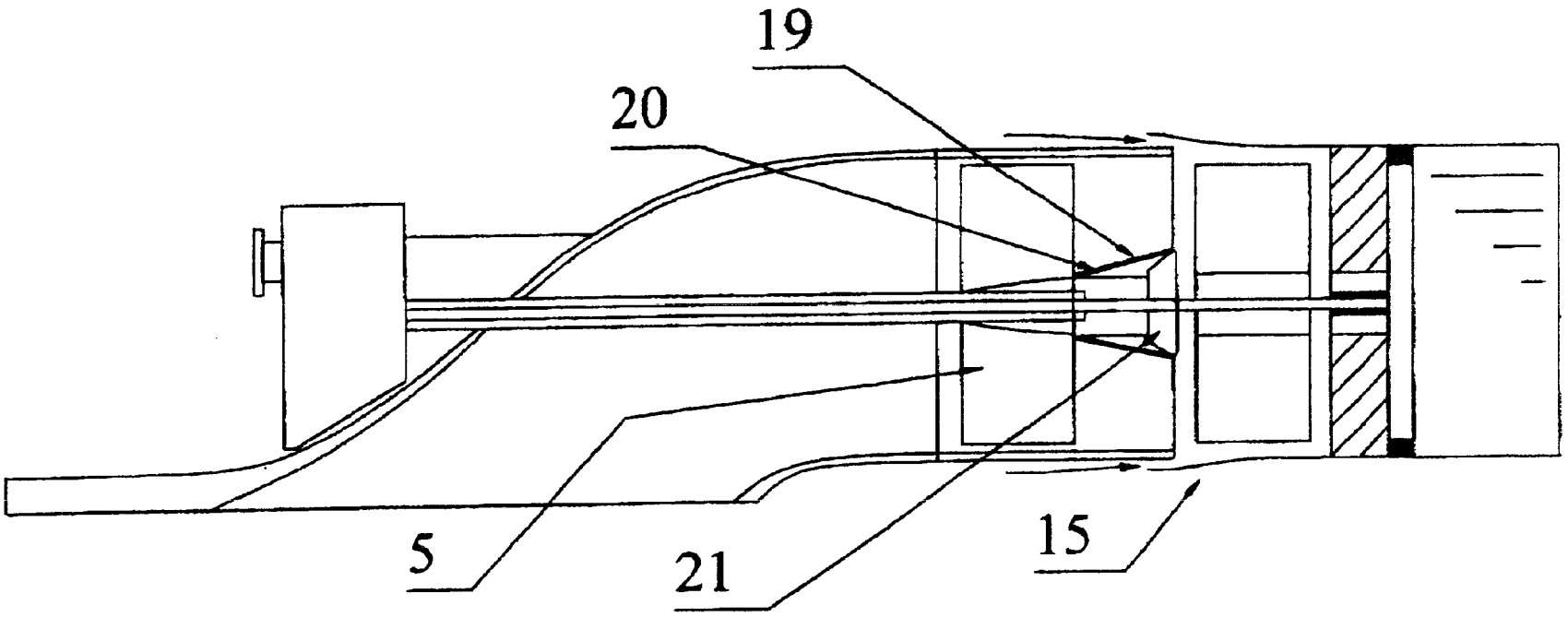
FIG. 3 describes a basic pump unit in a simplified side elevational view with an air entry control system located between the impellers. A pressure control priming device is located between the impellers but in this example is fixed to the centre of the pump casing.

In FIG. 5, (External view FIG. 4 without cut away section) the propulsion unit consists of a transmission 1 providing counter-rotation of coaxial shafts 2 and 3. The design details for this are outlined in our New Zealand Patent 256488. Water is drawn through an intake section 4 thence through impellers 5 and 6 contained within pump housings 7 and 8 which are fixed to coaxial shafts 2 and 3. A nozzle section 9 is located between the two impellers 5 and 6 and includes a spring loaded collapsible skirt 10 which helps to facilitate priming and control of pressure inside the unit. The upstream impeller 5 and nozzle section 9 are pressurized in the range of about 0–276 kPa (or greater if desired) over the operating range of the unit. The helically spinning water passes through the nozzle section 9 and impinges on the downstream impeller 6 which is operating at atmospheric pressure. Air 11 enters the area immediately downstream of the nozzle section 9 thus reducing cavitation and friction but primarily serving to limit hydraulic suction on the downstream impeller 6, thereby maintaining a constant operating environment approximating atmospheric pressure. To assist priming and maintain a low pressure environment the air inlets 12 are controlled by a sliding ring 13, FIG. 5 which is operated by a hydraulic spring loaded slave cylinder 14, FIG. 4 which pushes the ring backwards/forwards. In an alternative arrangement, as seen in FIG. 2, flaps 15 are used for this purpose. The flaps 15 being controlled either hydraulically, by the pressure of the water or indirectly by electro-magnetically controlled latches, not shown, so that they are closed at start-up and fully open at full power. A three or four vane bearinged support 16 in the outlet to the pump housing 8 provides support for the coaxial drive shafts 2 and 3. Steering flaps 17 are attached to the pump housing 8 by pinned hinges 18. A steering mechanism is not shown.

What is claimed is:

1. A water jet propulsion unit comprising:

an intake section; a pump section which includes a pump housing enclosing an upstream axial flow impeller followed immediately downstream by a pressure control priming device; followed by a second pump housing containing a further downstream impeller of opposite pitch; said downstream pump housing having an air entry control system; said air entry control system including a sliding ring being hydraulically operated so that the quantity of air entering the downstream pump housing can be controlled precisely; said air being permitted to enter the downstream pump housing via ports cast into the downstream pump housing; said impellers being separately mounted on contra rotating shafts; said coaxially arranged shafts being located at the outlet end of the downstream pump housing by a bearinged three or four vane support; said impellers being able to individually rotate at peripheral speeds above 30 meter per second; said downstream impeller being permitted to operate at atmospheric pressure whilst in operating mode; said intake housing, upstream and downstream pump housings, all being in smooth communication with each other; said water jet propulsion unit being able to be configured to operate in a pressure range above or below 276 kPA.

2. A propulsion unit as claimed in claim 1, wherein the impellers have peripheral blade angles in the range of 10 to 50 degrees depending on pump configuration.

3. A propulsion unit as claimed in claim 1, wherein the downstream impeller has a ring attached to its blades such that no enclosing pump housing is required.

4. A propulsion unit as claimed in claim 1, wherein the pressure control priming device is located between the two contra rotating impellers.

5. A propulsion unit as claimed in claim 1, wherein the pressure control priming device is mounted to the centre of the upstream impeller.

6. A propulsion unit as claimed in claim 1, wherein the entry of air is controlled by flaps being able to be activated remotely by electro mechanical means.

7. A water jet propulsion unit comprising:

an intake section; a pump section which includes a pump housing enclosing an upstream impeller followed immediately downstream by a pressure control priming device; followed by a second pump housing containing a further downstream impeller of opposite pitch; said downstream pump housing having an air entry control system; said air entry control system including a sliding ring being hydraulically operated so that the quantity of air entering the downstream pump housing can be controlled precisely; said air being permitted to enter the downstream pump housing via ports cast into the downstream pump housing; said impellers being separately mounted on contra rotating shafts; said downstream impeller being permitted to operate at atmospheric pressure whilst in operating mode; said intake housing, upstream and downstream pump housings; all being in smooth communication with each other.

* * * * *